United States Patent [19]

Thomas et al.

[11] Patent Number: 4,531,496

[45] Date of Patent: Jul. 30, 1985

[54] FUEL INJECTION PUMPS

[75] Inventors: Gerald S. Thomas, Longlevens; John Punshon, Hucclecote; John A. Barr, Longlevens, all of England

[73] Assignee: Lucas Industries, Birmingham, England

[21] Appl. No.: 391,964

[22] Filed: Jun. 24, 1982

[30] Foreign Application Priority Data

Jul. 10, 1981 [GB] United Kingdom ..... 8121312

[51] Int. Cl.[3] ..... F02M 39/00

[52] U.S. Cl. ..... 123/495; 123/509; 123/503; 417/499; 411/517

[58] Field of Search ..... 123/495, 509, 501, 500, 123/503, 502; 74/99 R, 102; 411/353, 517, 518, 519, 521, 522; 417/499, 494

[56] References Cited

U.S. PATENT DOCUMENTS

| | | | |
|---|---|---|---|
| 1,778,158 | 10/1930 | L'Orange | 123/495 |
| 2,411,761 | 11/1946 | Stolberg | 411/517 |
| 2,487,803 | 11/1949 | Heimann | 411/517 |
| 3,972,655 | 8/1976 | Tsunematsu | 417/494 |
| 4,286,931 | 9/1981 | Häfele | 417/499 |

*Primary Examiner*—Carl Stuart Miller

[57] ABSTRACT

A fuel injection pump of the reciprocable plunger type has a pump plunger which is slidable within a pump barrel about which is mounted an angularly movable sleeve. The sleeve and plunger are interconnected so that they can move axially relative to each other but are restrained against relative angular movement. An arm is coupled to the sleeve its inner end lying within a slot in the sleeve, the arm being provided with limbs which lie within a circumferential groove, the arms embracing the sleeve to retain the inner end of the arm within the slot.

6 Claims, 3 Drawing Figures

FUEL INJECTION PUMPS

This invention relates to fuel injection pumps for supplying fuel to an internal combustion engine and of the kind comprising a plunger reciprocable within a pump barrel, a sleeve mounted about the barrel, interengaging means on the plunger and sleeve whereby the plunger can partake of axial movement relative to the sleeve but angular movement of the sleeve will be transmitted to the plunger and means carried by the sleeve whereby the angular setting of the sleeve can be varied.

There is means for imparting angular movement to the sleeve known in the art. For example, it is known to clamp a toothed segment on the sleeve, the teeth in use engaging teeth on an axially movable rack bar. This form of construction has largely been superseded by providing a radial arm on the sleeve, the arm at its outer end being adapted to be engaged by a component for example, a fork, carried by an axially movable rod or bar. Various methods of attaching the arm to the sleeve have been used and most of these involve a brazing operation. Such an operation is expensive and time consuming and often means that a subsequent machining operation is required.

The object of the present invention is to provide a pump of the kind specified in a form in which the arm is secured to the sleeve in a simple and convenient assembly operation.

According to the invention in a pump of the kind specified said means comprises an arm having one end shaped to locate within a recess formed in the sleeve and a pair of limbs extending from the arm in opposite directions, said limbs being shaped to at least partly embrace the sleeve to retain said one end of the arm within said recess.

According to a further feature of the invention said sleeve is provided with a circumferential groove in which said one end of the arm and said limbs are located.

According to a still further feature of the invention said one end of the arm has tapered sides, and the recess has substantially radial sides, said limbs being shaped to draw said one end of the arm into said recess.

An example of a fuel injection pump in accordance with the invention will now be described with reference to the accompanying drawings.

Figure 1:
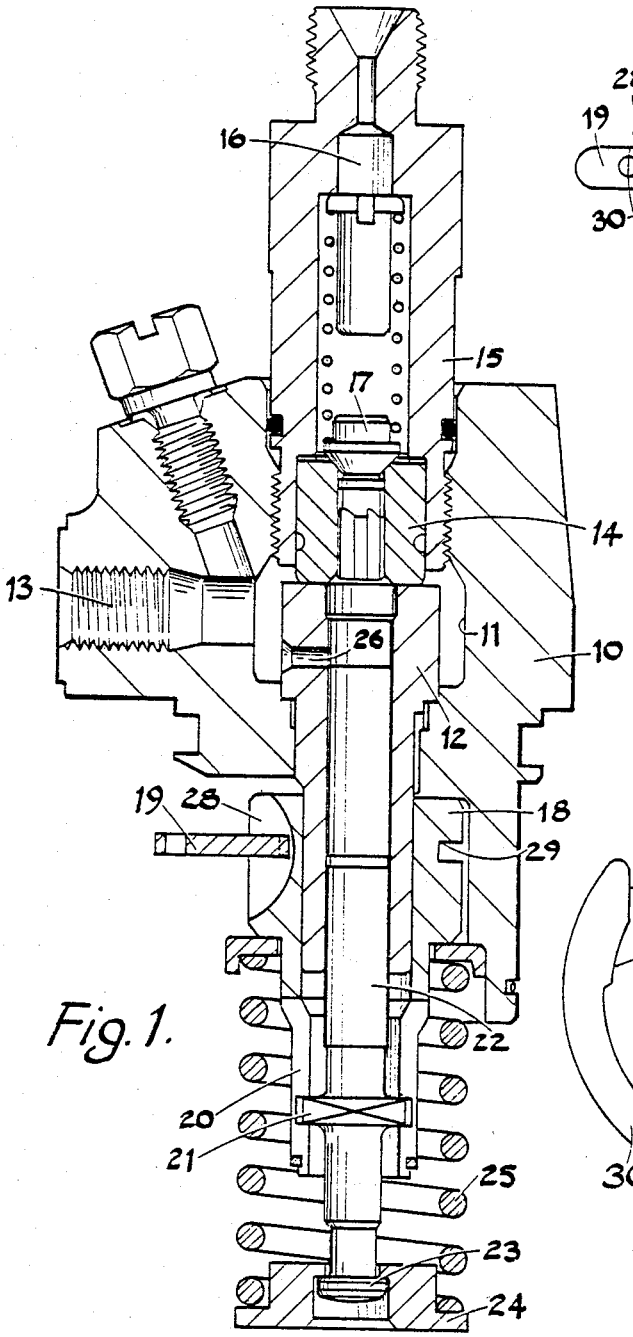
FIG. 1 is a sectional side elevation of the completed pump.

Referring to the drawings the pump comprises a body 10 in which is defined a stepped bore having an enlarged portion 11 which with a flanged pump barrel 12, defines a chamber to which fuel is supplied in use through a fuel inlet 13, the latter being formed in a lateral extension of the body.

The pump barrel has a flanged upper portion which locates against a step defined in the bore, the barrel being urged into engagement with this step by the abutment with the end surface of the barrel, of a delivery valve housing 14. The housing 14 is retained in position by a plug 15 which defines a fuel outlet 16 and the housing 14 mounts a spring loaded delivery valve member 17.

The pump barrel is cylindrical and extends beyond the bore to define a cylindrical surface about which is located a sleeve 18 having a radial arm 19 whereby the angular setting of the sleeve can be varied. The sleeve defines a pair of longitudinal slots 20 within which are located ears 21 formed on a pump plunger 22 which is slidable within the bore in the barrel. The end of the plunger is provided with a head 23 with which is engaged a spring abutment 24 against which is located a coiled compression spring 25 acting in use, to urge the plunger 22 out of the bore in the barrel. The pump is designed to be mounted in a housing which includes a cam shaft arranged to impart inward movement to the plunger.

In known manner the pump barrel is provided with a spill/inlet port 26 which communicates with the aforesaid chamber and which is uncovered by the plunger during its outward movement, to allow flow of fuel into the bore. During inward movement of the plunger the port 26 is covered so that delivery of fuel takes place through the outlet 16, but at some point the port 26 is brought into register with a helical groove (not shown) which is formed in the plunger. The instant at which the groove on the plunger communicates with the port 26 to terminate delivery of fuel, depends upon the angular position of the plunger relative to the pump barrel and this is determined by the angular position of the sleeve 18. The arm 19 is connected to an adjusting mechanism whereby the angular setting of the plunger can be varied.

The inner end of the arm 19 has tapered sides 27 to located in an axially extending parallel sided slot 28 formed in the flanged portion of the sleeve 18. Conveniently the slot 28 is formed using a milling cutter.

Also formed in the flanged portion of the sleeve is a circumferential groove 29. The width of the groove is substantially equal to the thickness of the arm 19.

Figure 2:
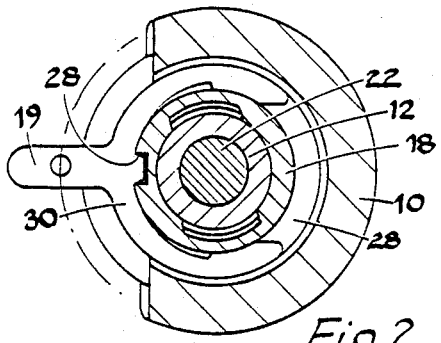
FIG. 2 shows a section through a part of the pump.
Figure 3:
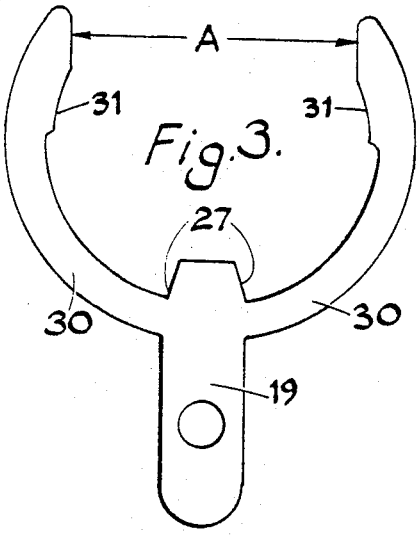
FIG. 3 is a plan view through an enlarged scale of a part of the pump seen in FIG. 2.

Integrally formed with the arm 19 is a pair of arcuate limbs 30 which extend from the arm in opposite directions. The free ends of the limbs define between them a clearance indicated by the dimension A which is slightly less than the diameter of the base wall of the groove 29. The material from which the arm and limbs is formed is resilient and the arrangement is such that with the limbs located in the groove 29, the sleeve can be passed through the clearance A, slight flexure of the limbs occurring in this process. The free ends of the limbs also define pressure surfaces 31 which after the sleeve has been passed through the clearance A, engage with the base wall of the groove 29. It will be observed that the pressure surfaces are disposed at more than 90° from the axis of the arm 19 so that when the surfaces 27 locate in the slot 28, the resilience of the material from which the arm and limbs are formed, will tend to draw the end portion of the arm into the groove 28. The pressure surfaces 31 are radiused to engage substantially over their whole length, with the base wall of the circumferential groove 29. When the arm and limbs are mounted about the sleeve, the sleeve can be assembled to the pump barrel 12. As will be seen in FIG. 2, the body 10 defines an opening through which the arm 19 extends, the opening being sufficient to allow the desired range of movement of the arm. It will also be noted that once the sleeve is in position, it is impossible to remove the arm and the limbs because of interference with the body 10.

It will be observed that the arm 19 is provided with an aperture in which can be mounted any convenient member such for example as a ball member, for co-operation with forks carried by an axially movable control rod or bar.

The method of securing the arm 19 to the sleeve as described above, is particularly convenient since it involves no brazing operation so that the various components can be fully machined before assembly of the arm to the sleeve is effected.

We claim:

1. A fuel injection pump for supplying fuel to an internal combustion engine comprising a plunger reciprocable within a pump barrel, a sleeve mounted about the barrel, interengaging means on the plunger and sleeve whereby the plunger can partake of axial movement relative to the sleeve but angular movement of the sleeve will be transmitted to the plunger, means carried by the sleeve whereby the angular setting of the sleeve can be varied, said means comprising a groove in the outer periphery of said sleeve, said groove extending circumferentially about said sleeve, a recess in the outer periphery of said sleeve, said recess extending axially of said sleeve and intersecting said groove, a rotatable arm having a projection thereon shaped to snugly seat within said recess for coupling said arm to said sleeve so said sleeve is rotated when said arm is rotated, and a pair of limbs extending from the arm in opposite directions, said limbs being received in said circumferential groove and being shaped to at least partly embrace the sleeve to retain said projection within said recess.

2. A pump according to claim 1, in which the sides of said projection of the arm taper and the sides of said recess are radially disposed.

3. A pump according to claim 1 in which said groove has a thickness just slightly larger than the thickness of said limbs for snugly receiving said limbs.

4. A pump according to claim 1 in which the depth of said groove as measured from the sleeve peripheral surface to the bottom of the groove is less than the depth of said recess as measured from the sleeve outer peripheral surface to the bottom of the recess.

5. A pump according to claim 1 wherein said arm includes means for attaching said arm to a control means.

6. A pump according to claim 1 in which said limbs are arcuate in shape and define arcuate pressure surfaces, said pressure surfaces being located on said limbs more than 90° from a point in which the axis of said limbs intersect the axis of the arm, and said pressure surfaces having radii such that they engage over the whole of their lengths with the base wall of the groove.

* * * * *